United States Patent [19]

Arnett et al.

[11] Patent Number: 4,545,282

[45] Date of Patent: Oct. 8, 1985

[54] CHORD SELECTOR DEVICE FOR STRINGED MUSICAL INSTRUMENTS

[76] Inventors: Joseph Arnett; Jo A. Arnett, both of 2102 Lake Forest Dr., Tallahassee, Fla. 32303

[21] Appl. No.: 551,114

[22] Filed: Nov. 14, 1983

[51] Int. Cl.[4] ..... G10D 3/00

[52] U.S. Cl. ..... 84/317

[58] Field of Search ..... 84/315-317

[56] References Cited

U.S. PATENT DOCUMENTS

| | | | |
|---|---|---|---|
| 546,457 | 9/1895 | Pietsch | 84/317 |
| 627,410 | 6/1899 | Graus | 84/317 |
| 1,437,026 | 11/1922 | Spartivento | 84/317 |
| 1,635,542 | 7/1927 | Connor | 84/317 |

*Primary Examiner*—Lawrence R. Franklin

*Attorney, Agent, or Firm*—Alfred E. Wilson

[57] ABSTRACT

A button actuated chord selector and playing device for simultaneously pressing a plurality of selected strings of a stringed musical instrument, such as a guitar, against the spaced frets of the instrument to shorten the vibrational length of the strings, to increase the pitches of the instrument, and, thereby, to produce selected harmonizing chord sounds. Each button operates its related actuating bar extending parallel with the neck of the instrument, and each of those actuating bars is operably connected to actuate a plurality of transversely extending selector bars positioned at different positions longitudinally on the neck of the instrument to engage and press selected strings against the spaced frets to produce the selected chord. Laterally spaced guide pins are provided at opposite ends of the actuating and selector bars to limit movement of the bars and to keep opposite ends of the bars moving in unison. Springs positioned at opposite ends of the bars are provided to lift the actuating and selector bars when the buttons are released.

1 Claim, 4 Drawing Figures

CHORD SELECTOR DEVICE FOR STRINGED MUSICAL INSTRUMENTS

BACKGROUND OF THE INVENTION

The playing of stringed instruments such as the guitar, banjo, ukulele, mandolin and the like requires that the fingers of one of the musician's hands press a particular string into engagement with one of a selected transversely extending frets to "stop" the string, meaning to change the vibrational length of a string to change the pitch or tonal quality of the sound produced by the vibrating string and which is amplified by the sound box of the instrument. To produce a chord, or the sound produced for example by three strings "stopped" or pressed into engagement with their respective frets, which are spaced longitudinally along the neck of the instrument, it is necessary for the musician to press the three laterally spaced strings into engagement with their respective frets positioned at different longitudinally spaced locations along the neck of the instrument. This of necessity requires a considerable degree of dexterity, and the ability of the musician to make the necessary changes rapidly to produce the desired chords.

FIELD OF INVENTION

There are many persons who desire to be able to play a stringed instrument to enable them to accompany singing for example, by producing selected chords rapidly on a stringed instrument, but who are unable for some reason, such as a physical handicap or they are unwilling to devote the time and energy required to learn to play an instrument in the usual way. For those people it is desirable to have available a device by which they can depress one button and have an automatic "stopping" or engagement of selected strings with the appropriate frets to produce a desired chord.

BRIEF DESCRIPTION OF THE PRIOR ART

Various attempts have been made in the prior art to devise a mechanism by which various chords can be produced by actuating appropriate buttons to produce selected chords. These attempts have not been as successful as is desired because in some instances they are too cumbersome, and in other instances the chord playing mechanism is so complicated that it sticks or binds and becomes irratic in operation.

SUMMARY OF THE INVENTION

The present invention consists of a chord selector mechanism inclosed in a small housing adapted to be clamped to the neck of a stringed instrument such as a guitar, the housing being positioned over the strings. The top of the housing has a plurality of buttons, each button being marked with an appropriate chordal designation, and being operably connected through intersecting actuating and selector bars to "stop off" a plurality of the strings of the instrument at the various frets to produce the desired chordal notes. When applied to any of the stringed instruments the actuating bars are positioned to extend axially of the neck of the instrument. The actuating bars cross over or extend in a perpendicular direction to the selector bars which extend transversely of the neck of the musical instrument. When applied to the guitar there are six projections on the selector bars, one to engage each string to move it into contact with its associated fret to vary the chordal lengths of the particular strings to vary the pitch of the tone produced by that string as the strings are strummed. For example, three spaced selector bars are actuated as one of the chord selecting buttons is actuated. Each of the actuating and selector bars is guided at its opposite ends by a pin which extends through a bored hole in the ends of the bars to maintain the bars proper relation to each other, and to prevent cocking or binding of the bars as they are actuated. Yielding means such as coiled springs surrounding the pins yieldingly urge the actuating and selector bars to return to the string releasing positions. Thus when the pressure on a button is released the associated actuating and selector bars are immediately returned to their string releasing positions and the strings spring away from the frets against which they were urged. Each of the selector bars has one downwardly extending string engaging segment to engage a selected string between a particular pair of frets to produce the desired tonal quality required for a particular chord when a button is pushed. The other selector bars actuated by the selected button have string engaging segments to engage other strings, which may be laterally spaced to stop their respective strings between longitudinally spaced frets to produce the desired chordal tones.

The chord string selector bars or crossbars have the correct number and spacing of the strings engaging segments to produce the desired chordal tones as any of the chord producing buttons are actuated.

Strumming the strings with the other hand plays the chord, even when the player has no knowledge of what strings should be "stopped" or at what frets.

Our improved chord former also embodies the desirable feature that it is possible to reverse the strings on the instrument, and the internal order of the parts in the chord former. This will allow playing the instrument with the hand functions reversed to adapt it to people who for example are left handed.

Attention is also directed to the fact that the chord former has been constructed so that it can be easily removed from the instrument without damage or alteration of the instrument. It can also be positioned at different locations on the neck of the instrument the player may desire. This permits increasing the number of chords that can be played by operation of our invention.

An object of this invention is therefore to provide an improved chord selector which will not bind, and which will give uniform trouble free operation to permit parties who are not accomplished musicians to reap a high degree of enjoyment from these stringed instruments.

Another object of our invention is to provide a chord selector device which can easily be attached to a stringed instrument without damage to or alteration of instrument.

A further object is to provide a chord selector which will produce clear tones equal to manual fingering.

Another object is to provide a device that will not wear itself or produce string wear during prolonged use.

Still a further object is to provide enough chords to play the majority of musical compositions in the folk song area.

Another object resides in the provision of an easily usable device for the musically untrained to quickly and easily produce sounds suitable for singing and other amusement.

Our improved chord selector is capable of quick chord change such as is comparable with highly trained manual players.

Yet another object resides in the development of a device suitable for the training, encouragement and pleasure of people with physical handicaps and learning disabilities.

BRIEF DESCRIPTION OF THE DRAWING

Further objects and advantages of this invention will be apparent from the following description and claims, and from the accompanying drawings, wherein:

DESCRIPTION OF THE PREFERRED EMBODIMENT

Figure 1:
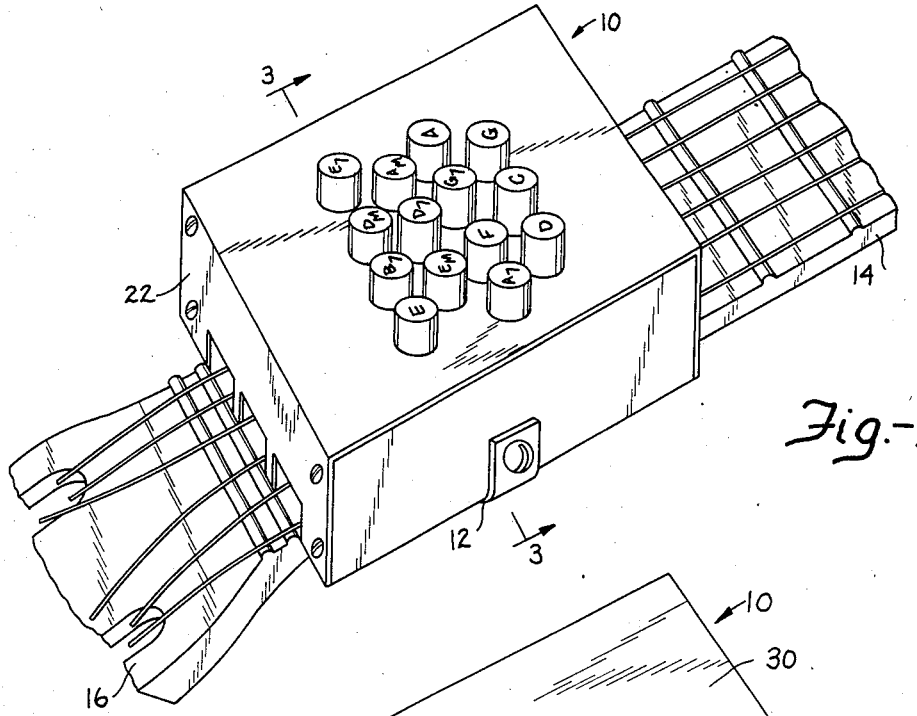
FIG. 1 is a fragmentary perspective view of the chord former of the present invention mounted on the neck of a guitar.

Referring now to the drawings, wherein like reference numerals indicate similar parts throughout the several views, the chord former 10 of the present invention includes a clamp 12 encircling the neck 14 of a guitar 16 or other fretted musical instrument. The main body 18 of the chord former 10 is located above the strings 20 on the neck 14. The chord former 10 is located on the neck 14 with the forward end 22 thereof adjacent to and touching the last one of a plurality of frets 24, and the clamp 12 is tightened by an appropriate means to hold the chord former 10 in the selected position on the neck 14. It will be apparent that the instrument may be played in the usual way when the chord former is not employed. When it is desired to use the chord former to play a selected chord, it is applied to the instrument and the appropriate button 26 is actuated and the instrument is then played in the usual manner by strumming the strings with the other hand.

When the chord former 10 is positioned on the neck 14 the legs 28 machined for example in the forward end 22 of the chord former 10 provides the necessary lateral clearance to avoid touching any of the strings 20.

Located in the top 30 of the chord former 10 are a plurality of buttons 32, each of which has a chord designation 34 located on the top surface of the buttons 32. The number of buttons 32 can be varied and depends on the number of chords which it is desired to have the chord former 10 provide. Each button 32 is set up to provide a separate chord. With the construction illustrated it will be apparent that fourteen separate and distinct chords can be formed.

Figure 2:
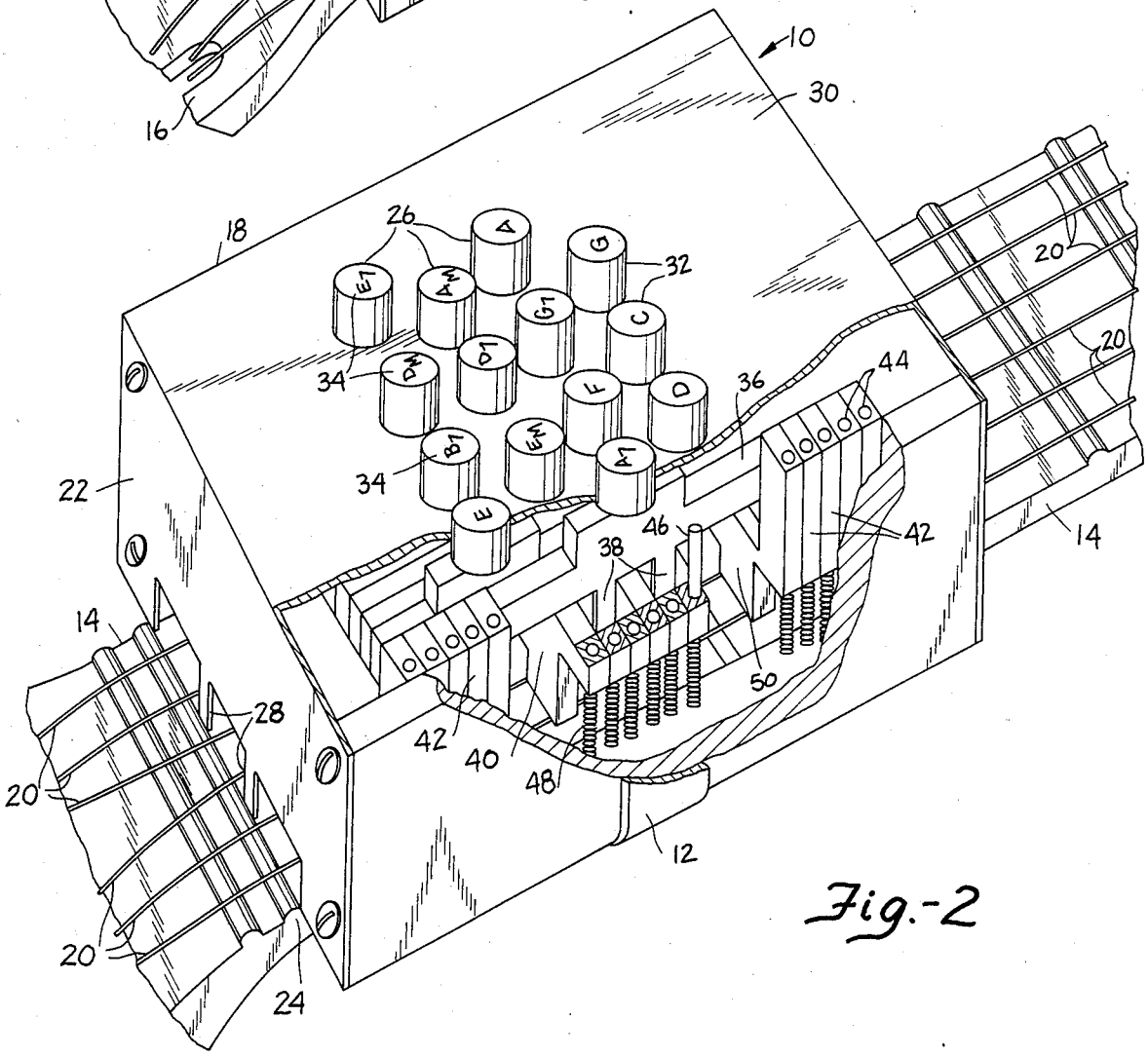
FIG. 2 is a part sectional perspective view similar to FIG. 1 illustrating the internal construction of the various parts.

Each of the fourteen buttons 32 illustrated in FIG. 2 is secured to a separate actuating bar 36 extending longitudinally of the neck 14 of the musical instrument. The bars 36 are narrow and are nested together beneath the buttons 32, the bars 36 being narrower than the buttons and the actuating bars 36 being nested to substantially lie within the width of the neck 14 of the instrument.

Each of the actuating bars 36 is provided with a downwardly extending actuating foot 38 which engages a particular transversely extending selector bar or crossbar 40. There are the same number of transversely extending selector bars or crossbars 40 as there are longitudinally extending bars 38, that is 14 for the embodiment illustrated. This also of course corresponds with the number of push buttons 32 which also identifies the number of separate chords which can be produced by the model illustrated.

Figure 3:
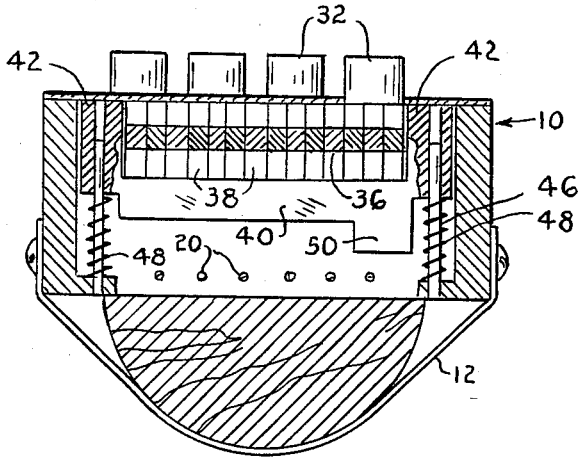
FIG. 3 is a sectional view taken substantially on the line 3—3 of FIG. 1, looking in the direction of the arrows.
Figure 4:
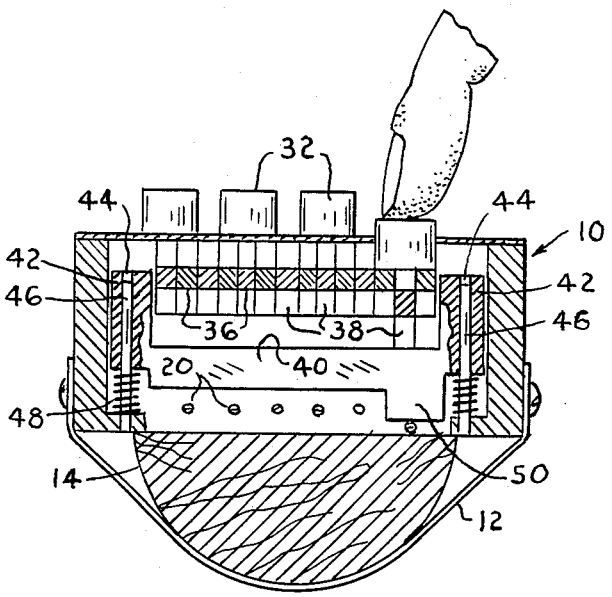
FIG. 4 is a view similar to FIG. 3 illustrating the positions of the parts when one of the actuating buttons has been depressed.

As illustrated in FIGS. 3 and 4 each of the selector bars or crossbars 40 is provided with upwardly extending legs 42 at opposite ends. The upwardly extending legs at opposite ends of the selector or crossbars 40 are provided with drilled holes 44 for the reception of pins 46 at opposite ends of the selector or crossbars 40. Pins 46 engage in the drilled holes 44 over an extended length, and thus maintain the selector or crossbars 40 moving in a straight line, free from cocking or binding which would interfere with the smooth operation of the chord former. Yielding means such as coiled springs 48 are provided by yieldingly urge the selector or crossbars 40 to move to the inoperative position as soon as the chord forming button 32 is released, and to urge the buttons 32 to their fully released or retracted position when they are released.

Each of the transversely extending selector or crossbars 40 is provided with a downwardly extended string engaging segment 50 to engage one of the strings 20 between a longitudinally spaced pair of frets 24 to shorten the portion of that particular string that is free to vibrate and have its tonal characteristics amplified by the music box of the musical instrument.

The downwardly extending string engaging segment 50 of the selector bars 40 engages and stops the appropriate string to form the desired chord as established by the arrangement of the buttons 32.

A plurality of selector or crossbars 40 are so positioned relative to each other that the string engaging segment 50 of adjacently positioned selector or crossbars 40 engage the strings between different pairs of frets 24 to produce the desired chord.

In order to play a chord using the chord former 10, it is only necessary to press the button 32 which displays the desired chord designation 34. As the button 32 is depressed to the limit of its movement, the motion is transmitted through the actuating bars 36 to move the selector or crossbar 40 down, and that moves the string engaging segments to provide the desired chord. As the selector or crossbars 40 move down the string engaging segments 50 carried thereby press the corresponding strings 20 onto the frets 24. This causes the strings 20 to rest over the frets 24 adjacent to the point where the string engaging segments 50 engage the strings 20 at the corresponding frets 24 thereby shortening the vibrational portions of the strings to produce the desired tone. Strumming the strings 20 with the other hand produces the appropriate chordal tone.

While a specific embodiment of a chord former for stringed musical instruments has been disclosed in the foregoing description, it will be understood that various modifications may be made within the spirit of the invention without departing from the spirit and scope of the appended claims.

We claim:

1. A chord former for a string type musical instrument having a neck provided with a plurality of longitudinally extending strings and longitudinally spaced transversely extending frets whereby the effective length of the strings can be varied by selectively pressing spaced strings into engagement with spaced frets comprising a housing having a main body adapted to be releasably secured to the neck of the instrument in such a manner as not to obstruct the strings, a plurality of chord selecting buttons in the upper surface of the housing, an actuating bar connected to each of the chord selecting buttons and extending longitudinally of the neck of the instrument, spaced guide pins at opposite ends of the longitudinally extending actuating bars to keep opposite ends of the actuating bars moving in unison, springs positioned at opposite ends of the actuating bars to lift the opposite ends of the bars when the buttons are released, a plurality of transversely extending selector crossbars, spaced guide pins at opposite ends of the selector bars to keep opposite ends of the transversely extending selector bars moving in unison, springs positioned at opposite ends of the selector bars to lift opposite ends of the selector bars when the chord selecting buttons are released, motion transmitting means including a downwardly extending actuating foot carried by each of the longitudinally extending actuating bars to engage a selected transversely extending selector bar, a downwardly extending string engaging segment carried by each of the transversely extending selector bars to engage a single string with an associated fret, the longitudinally extending actuating bars each having a plurality of downwardly extending actuating feet each of which is adapted to engage an associated transversely extending selector bar to engage a single string with its associated fret whereby actuation of a single chord forming button will engage a plurality of strings at the appropriately spaced frets to produce the chord selection indicated by the actuated button.

* * * * *